United States Patent [19]

Yoda et al.

[11] Patent Number: 4,984,004

[45] Date of Patent: Jan. 8, 1991

[54] DEVELOPING APPARATUS

[75] Inventors: Akira Yoda; Yoshimitu Sato; Takao Ozaki, all of Kanagawa, Japan

[73] Assignee: Fuji Photo Film Co., Ltd., Kanagawa, Japan

[21] Appl. No.: 413,508

[22] Filed: Sep. 27, 1989

[30] Foreign Application Priority Data

Sep. 28, 1988 [JP] Japan ..... 63-243318
Sep. 28, 1988 [JP] Japan ..... 63-243319
Sep. 28, 1988 [JP] Japan ..... 63-243320

[51] Int. Cl.[5] ..... G03D 5/00

[52] U.S. Cl. ..... 354/317; 354/324; 355/256; 118/659

[58] Field of Search ..... 354/317, 324, 325; 355/256, 247, 248; 118/659, 660

[56] References Cited

U.S. PATENT DOCUMENTS 3,727,578 4/1973 Saito et al. ..... 354/317 X
3,943,541 3/1976 Hirafuji ..... 355/256 X
3,985,437 10/1976 Kuehnle ..... 355/256 X
4,133,906 1/1979 Kuehnle ..... 118/659 X
4,265,996 5/1981 Simm et al. ..... 118/659 X
4,793,281 12/1988 Dobbins et al. ..... 118/660 X

*Primary Examiner*—A. A. Mathews
*Attorney, Agent, or Firm*—Sughrue, Mion, Zinn, Macpeak & Seas

[57] ABSTRACT

A developing apparatus for effecting development by supplying a developing solution to a developing area of a light-sensitive material has a multiple-hole plate; a pressurizing chamber disposed on one side of the multiple-hole plate and adapted to pressurize the developing solution; and a vibrating device for pressurizing the developing solution by vibrating the multiple-hole plate so as to cause the developing solution to be jetted and supplied to the developing area in the form of droplets through the holes of the multiple-hole plate. Accordingly, the amount of the developing solution supplied wastefully is minimized.

20 Claims, 10 Drawing Sheets

DEVELOPING APPARATUS

BACKGROUND OF THE INVENTION

1. Field of the Invention

The present invention relates to a developing apparatus for developing a light-sensitive material, and more particularly to a developing apparatus for developing a light-sensitive material after converting a developing solution into droplets and supplying the same to the surface of the developing material.

2. Statement of the Related Art

As a method of supplying a developing solution when a developing solution is supplied to the surface of an imagewise exposed light-sensitive material to effect development processing, methods are generally adopted in which the light-sensitive material is immersed in the developing solution, or the developing solution is continuously supplied to the surface of the light-sensitive material.

With the above-described methods, however, an excessive amount of developing solution is supplied to the surface of the light-sensitive material in addition to the portion of the developing solution necessary for developing a light-sensitive material. For this reason, the developing solution has been used wastefully.

To solve this problem, the so-called liquid spraying method in which a developing solution is converted into droplets and sprayed to the surface of a light-sensitive material has been conceived as a method of supplying a developing solution which does not use the developing solution wastefully.

However, with the above-described liquid spraying method in which a developing solution is sprayed to the surface of a light-sensitive material, since the developing solution is sprayed from a nozzle to the surface of a light. sensitive material in a dispersed manner, the amount of the developing solution supplied varies between a central portion of the light-sensitive material and its surrounding portions. As a result, there occurs the problem that it is impossible to supply the developing solution uniformly to the surface of the light-sensitive material, making it impossible to develop the light-sensitive material uniformyy.

For this reason, it is conceivable to arrange a plurality of nozzles in such a manner as to oppose the developing area of the light-sensitive material and spray the developing solution uniformly to the surface of the light-sensitive material so as to supply the developing solution uniformly to the surface of the light-sensitive material. However, it is difficult to arrange a plurality of nozzles in face-to-face relationship with the surface of the light-sensitive material. In addition, with an apparatus in which development processing is effected by disposing a developing electrode on the surface of the light-sensitive material to adjust the amount of the developing solution adhering to the light-sensitive material, it is difficult to arrange a plurality of nozzles for jetting the developing solution in face-to-face relationship with the surface of the light-sensitive material.

Furthermore, it is extremely difficult to arrange a plurality of nozzles in face-to-face relationship with the surface of an electrophotographic film such as a microfilm having a small developing area.

In addition, a method has also been proposed whereby a developing solution in the form of sol is adsorbed by the surface of the light-sensitive material by a developing electrode so as to supply the developing solution to the surface of the light-sensitive material. In this case, however, there are cases where it is impossible to supply the developing solution uniformly to the surface of the light-sensitive material depending on the position of a supplying port for supplying the developing solution in the form of sol to the surface of the light-sensitive material.

SUMMARY OF THE INVENTION

Accordingly, an object of the present invention is to provide a developing apparatus which is capable of supplying a developing solution uniformly to the surface of a light-sensitive material uniformly without waste with a simple structure, thereby overcoming the above-described drawbacks of the conventional art.

To this end, according to the present invention, there is provided a developing apparatus for developing a developing area of a light-sensitive material by supplying a developing solution thereto, comprising: a multiple-hole plate in which a plurality of small holes are formed in correspondence with the developing area of the light-sensitive material; a pressurizing chamber which is provided on the side of the multiple-plate which is remote from the side where the light-sensitive material is provided, a part of the pressurizing chamber being defined by the multiple-hole plate; supplying means for supplying the developing solution to the pressurizing chamber; and pressurizing means for periodically pressurizing the developing solution in the pressurizing chamber so as to cause the developing solution to be jetted and supplied to the developing area in the form of droplets via the small holes.

In the developing apparatus having the above-described arrangement, the developing solution is supplied to the interior of the pressurizing chamber by the supplying means. The developing solution supplied to the pressurizing chamber is periodically pressurized by the pressurizing means, and is jetted in the form of droplets toward the developing area of the light-sensitive material through the small holes formed in the multiple-hole plate. As a result, the developing solution is supplied to the developing area of the light-sensitive material, thereby developing the light-sensitive material.

Thus, in accordance with the present invention, since the developing solution is supplied to the developing area of the light-sensitive material in the form of droplets, it is possible to supply the developing solution to the light-sensitive material without waste to effect development of the light-sensitive material.

In addition, since a multiplicity of holes through which the developing solution is jetted in the form of droplets is formed in the multiple-hole plate, it is possible to supply the developing solution uniformly to the developing area of the light-sensitive material.

The above and other objects, features and advantages of the invention will become more apparent from the following detailed description of the invention when read in conjunction with the accompanying drawings.

DESCRIPTION OF THE PREFERRED EMBODIMENTS

Figure 1:
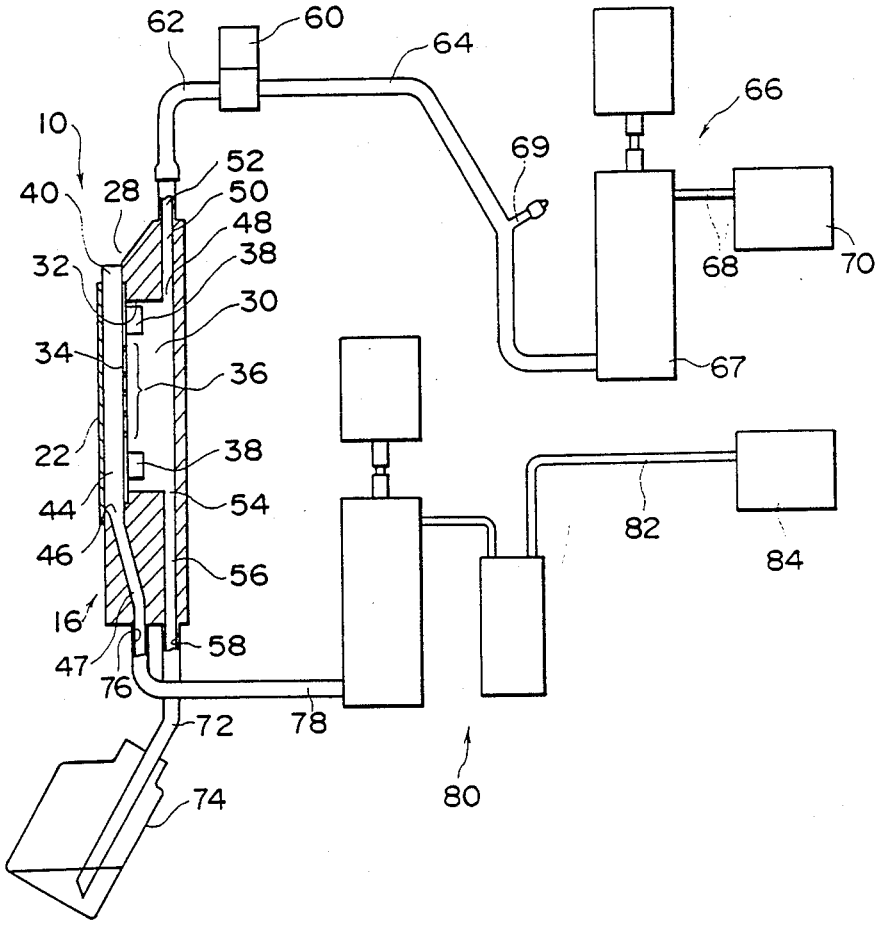
FIG. 1 is a cross sectional view taken along the line I I of FIG. 2, illustrating a developing section of a process head of a developing apparatus in accordance with a first embodiment of the present invention.
Figure 2:
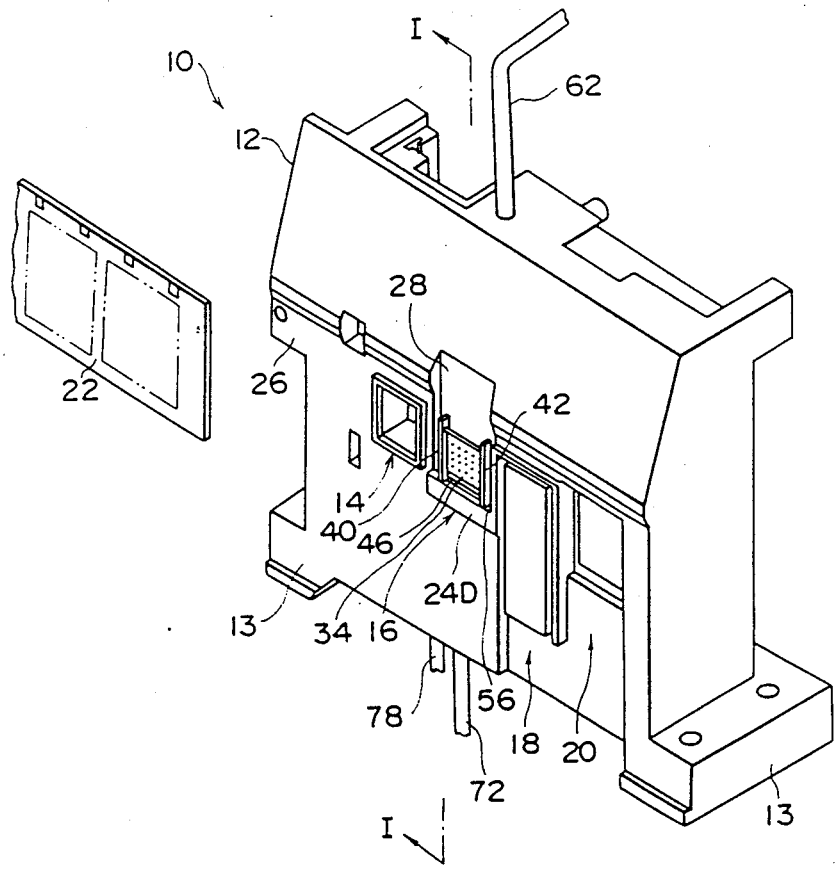
FIG. 2 is a perspective view illustrating the process head.
Figure 3:
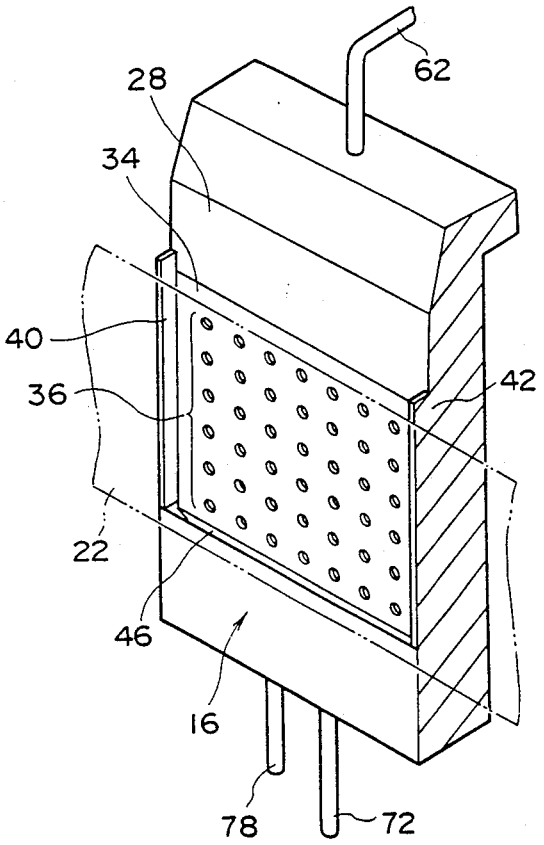
FIG. 3A is a perspective view illustrating the developing section.
FIG. 3B is a perspective view illustrating another example of the developing section.
Figure 3:
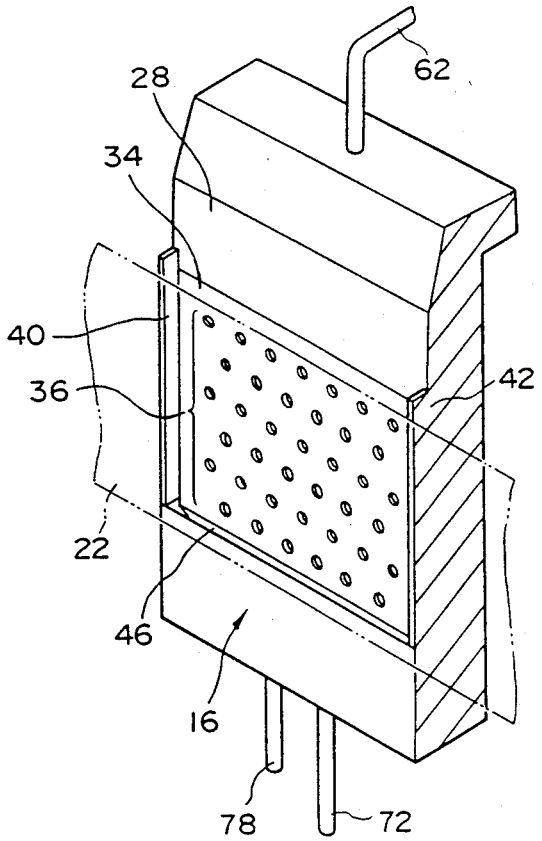

FIGS. 1 to 3B illustrate an embodiment of a process head 10 of a developing apparatus incorporated in an electrophotographic system. FIG. 1 is a cross-sectional view of a developing section 16 of the process head 10 taken along the line I—I of FIG. 2 and also illustrates the relationship between the developing section 16 and other devices. FIGS. 3A and 3B are perspective views of the developing section 16.

As shown in FIG. 2, the process head 10 comprises a relatively flat body 12 having a configuration of a substantially rectangular parallelepiped and a pair of legs 13 formed integrally on the lower side of the body 12, the body 12 and the legs 13 being formed integrally of a synthetic resin with the exception of fittings.

As shown in FIG. 2, a charging and exposing section 14, the developing section 16, a drying section, and a fixing section 20 are formed in that order in a transverse direction on the body 12 of the process head 10 at predetermined pitches corresponding to the pitches of frames of an electrophotographic film 22.

In the charging and exposing section 14, the electrophotographic film 22 (corresonding to one frame) located in this section is charged and then irradiated with an image light from an unillustrated original so as to be exposed. As a result, an electromagnetic latent image corresponding to an image pattern of the original is formed on the electrophotographic film 22.

In the developing section 16, a liquid developing solution is applied to the electrophotographic film 22 exposed in the charging and exposing section 14, and the latent image is thereby converted into a visible image.

In the drying section 18, dry air is blown to the electrophotographic film 22 wetted with the liquid developing solution, and the moisture is thereby removed.

In the fixing section 20, the image is fixed to the electrophotographic film 22 by means of a fixing lamp and the like.

In the developing section 16, as shown in FIGS. 1 to FIG. 3B, a pressurizing chamber 30 is provided in a recess 28 formed in a front wall 26 of the process head 10, the pressurizing chamber 30 being open to the front wall 26 side.

An opening 32 of this pressurizing chamber 30 is totally closed by a diaphragm 34. This diaphragm 34 is formed of an electrically conductive material, for instance, a stainless steel plate having a thickness of about 30–50 μm. As shown in FIGS. 3A and 3B, small holes 36 are formed in the diaphragm 34 in such a manner as to allow the front and rear sides of the diaphragm 34 to communicate with each other. Specifically, the small holes 36 are arranged at equal intervals in both vertical and horizontal directions, as shown in FIGS. 3A and 3B. The region where these small holes 36 are formed corresponds to a developing area of the electrophotographic film 22, and its size is, for instance, approximately 10×8 mm. The distance between adjacent ones of the small holes 36 is 200–300 μm, and the small holes 36 are arranged uniformly into the configuration of a lattice. In the aforementioned 10×8 mm region, about 200–500 small holes are formed. In addition, the small holes 36 may be alternatively arranged in zigzag form, as shown in FIG. 3B. The diameter of each of these small holes 36 is set at 10–100 μm.

Figure 4:
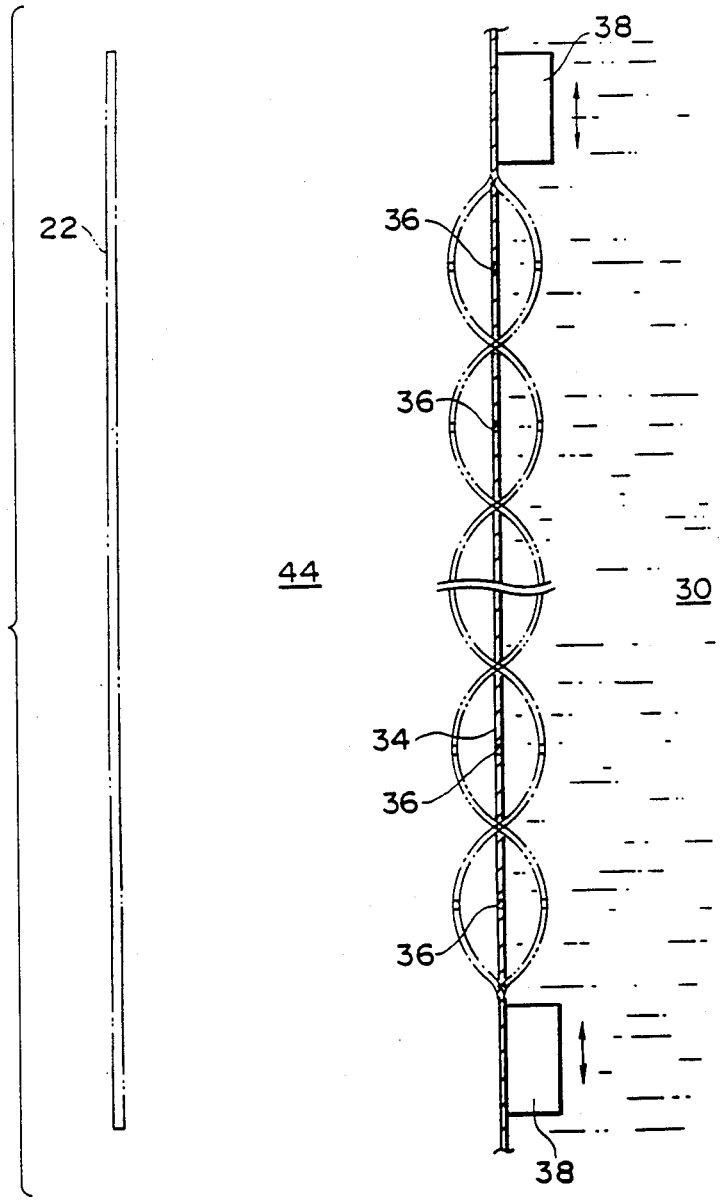
FIG. 4 is a cross-sectional view illustrating the relationship between a diaphragm and an electrophotographic film.

A pair of piezoelectric vibrators 38 are respectively formed in upper and lower portions of the diaphragm 34 on a rear side thereof, i.e., on the inner side of the process head 10. This piezoelectric vibrators 38 are connected to an unillustrated voltage applying means. The piezoelectric vibrator 38, which is a so-called piezoelectric element, has the voltage characteristic of producing a straining force whereby the piezoelectric vibrator 38 vibrates in a vertical direction, as indicated by double-headed arrows in FIG. 4. The piezoelectric vibrators 38 are adapted to vibrate an intermediate portion of the diaphragm 34 in waveform at frequencies of about 20–100 kHz by means of the straining force, as shown in FIG. 4.

As shown in FIG. 1, an air outlet port 48 is formed in an upper portion of the pressurizing chamber 30 and communicates with a passage 50 formed by an inner space of the process head 10. The passage 50 communicates with an air suction port 52 which is open at an upper surface of the process head 10.

A developing solution supplying port 54 is formed in a lower portion of the pressurizing chamber 30 and communicates with a passage 56 formed by an inner space of the process head 10. The passage 56 communicates with a developing solution inlet port 58 which is open at a lower surface of the process head 10.

As shown in FIG. 1, the air suction port 52 communicates with a gas/liquid separator 66 by means of pipelines 62, 64 with a valve 60 interposed therebetween. An air pump 70 communicates with the gas/liquid separator 66 through a pipeline 68 and is adapted to supply negative pressure to the gas/liquid separator 66. The developing solution in the pressurizing chamber 30 is sucked into the gas/liquid separator 66 by means of this negative pressure.

The gas/liquid separator 66 separates the developing solution, which contains air and flows into a separating tank 67 via the pipeline 64, into air and the developing solution, thereby preventing the developing solution from entering the air pump 70.

A branch pipeline 69 bifurcates midway in the pipeline 64 and communicates with an unillustrated pressure regulating valve. By virtue of this pressure regulating valve, the negative pressure supplied by the air pump 70 is regulated so as to control the amount of developing solution sucked up.

The developing solution inlet port 58 communicates with a bottle 74 by means of a pipeline 72.

As shown in FIGS. 2, 3A, and 3B, disposed on widthwise opposite sides of the pressurizing chamber 30 left and right frames 40, 42 projecting forwardly from the recess 28. The electrophotographic film 22 located in the developing section 16 abuts against the left and right frames 40, 42, and a space surrounded by the diaphragm 34, the left and right frames 40, 42, and the electrophotographic film 22 constitutes a developing chamber 44. An upper portion of the developing chamber 44 is open and communicates with the outside.

The left and right frames 40, 42 are formed integrally with the body 12 of the process head 10, and a developing solution outlet port 46 is formed in a lower portion of the developing chamber 44 over the entire widthwise area of the developing section 16. The developing solution outlet port 46 communicates with a passage 47 formed by an inner space of the process head 10. The passage 47 communicates with a developing solution discharge port 76 which is open at the underside of the process head 10. The developing solution discharge port 76 communicates with a gas/liquid separator 80 by means of a pipeline 78. The gas/liquid separator 80 communicates with an air pump 84 by means of a pipeline 82 which supplies negative pressure to the gas/liquid separator 80.

A description will now be given of the operation of this embodiment.

The respective frames of the electrophotographic film 22 are respectively sent to and processed by the charging and exposing section 14, developing section 16, drying section 18, and fixing section 20, in the order just mentioned, which are juxtaposed on the process head. Thus images are recorded on the electrophotographic film 22.

In this case, an unillustrated film moving motor is driven, and a predetermined frame selected freely from unrecorded films is located in front of the charging and exposing section 14. An operation for selecting this predetermined frame is carried out as a control keyboard for operating an electrophotographic system (neither are shown) incorporating the process head 10 is operated to specify that frame.

By taking note of this predetermined frame, a description will be given of a case in which the predetermined frame is sent from the charging and exposing section 14 to the fixing section 20 via the developing section 16 and the drying section 18 so as to record an image.

A predetermined frame selected freely from unrecorded frames is located in the charging and exposing section 14 where it is charged and exposed imagewise to form an electrostatic latent image.

The frame on which the electrostatic latent image has been formed is moved to the developing section 16 by the film moving motor.

In the developing section 16, the air pump 70 has been operated and supplied negative pressure to the pressurizing chamber 30 via the gas-liquid separator 66. As a result, the developing solution stored in the developing solution bottle 74 is thus sucked up into the pressurizing chamber 30, and the developing solution is filled in the pressurizing chamber 30.

When the predetermined frame of the electrophotographic film 22 is moved to the developing section 16, a voltage is applied to the piezoelectric vibrators 38 by means of an unillustrated voltage applying means. Upon application of this voltage thereto, the piezoelectric vibrators 38 vibrate vertically as shown by the double-headed arrows in FIG. 4, thereby causing the diaphragm 34 to expand and shrink in a vertical direction. By virtue of this expansion and shrinkage, an intermediate portion of the diaphragm 34 vibrates in waveform, as shown in FIG. 4. Due to this vibration, the developing solution in the pressurizing chamber 30 is jetted from the small holes 36 into the developing chamber 44 in the form of droplets and is supplied thereto in the form of a mist, and the surface of the one frame of the electrophotographic film 22 is coated therewith. As a result, the electrostatic latent image formed on the electrophotographic film 22 is converted into a visible image by this developing solution.

Since the developing chamber 44 is formed by the diaphragm 34, left and right frames 40, 42, and electrophotographic film 22, the developing solution jetted into the developing chamber 44 is prevented from scattering to the outside.

Although the upper part of this developing chamber 44 is open, since negative pressure is applied to the developing chamber 44 by the air pump 84 which is an eliminating means for eliminating an excess developing solution, the developing solution in the developing chamber 44 in the form of droplets is sucked from the developing solution outlet port 46 and is supplied to the gas/liquid separator 80. As a result, the developing solution is prevented from scattering from above the developing chamber 44 to the outside.

A description will now be given of the basic principle in which the developing solution in the pressurizing chamber 30 is jetted from the small holes 36 in the form of droplets through the waveform vibration of the diaphragm 34.

As shown in FIG. 4, the diaphragm 34 vibrates in waveform by the action of the piezoelectric vibrators 38. Each of the small holes 36 is formed at a portion of the diaphragm 34 which constitutes a crest of a wave. For this reason, each portion of the diaphragm surrounding the small hole 36 undergoes a maximum amount of deflection in a transverse direction as viewed in FIG. 4. Hence, the developing solution in the pressurizing chamber 30 is periodically pressurized, and is jetted from the small holes 36 into the developing chamber 44.

Figure 5:
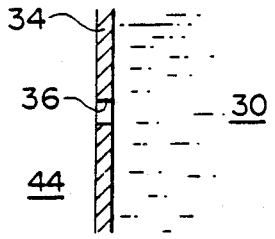
FIGS. 5A to 5E are diagrams illustrating a process in which the diaphragm vibrates and a developing solution is jetted.
Figure 5:
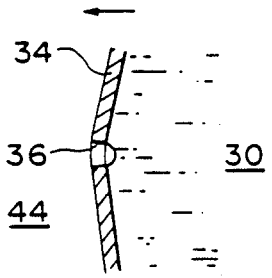
Figure 5:
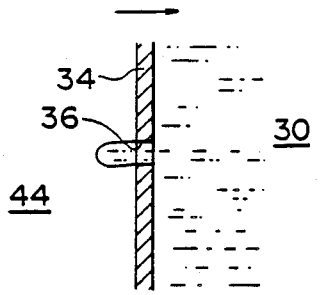
Figure 5:
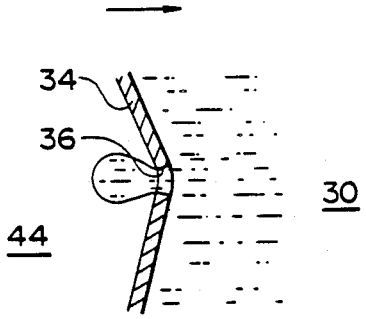
Figure 5:
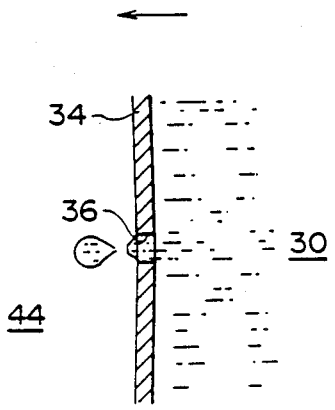

More specifically, the diaphragm 34 in a state shown in FIG. 5A vibrates by the action of the piezoelectric vibrators 38 and moves toward the developing chamber 44 side to assume a state shown in FIG. 5B. Then, the diaphragm 34 moves toward the pressurizing chamber 30 side by vibration and pressurizes the developing solution filled in the pressurizing chamber 30. When the diaphragm 34 comes to the center of vibration, as shown in FIG. 5C, the developing solution is extruded to the developing chamber 44 side from the small hole 36. Furthermore, the diaphragm 34 is displaced toward the pressurizing chamber 30 side to press the developing solution. In this state, as shown in FIG. 5D, the developing solution extruded from the small hole 36 tends to form a spherical configuration by its surface tension, and a portion of the developing solution at the small hole 36 begins to be constricted. The diaphragm 34 in this state 34 then further vibrates and moves toward the developing chamber 44 side. Consequently, as shown in FIG. 5E, the developing solution is separated and jetted into the developing chamber 44 in the form of a droplet. On the basis of this basic principle, the developing solution is supplied from the plurality of small holes 36 provided in the diaphragm 34 in the form of droplets or a mist, the surface of the light-sensitive material is coated therewith, subjecting the light-sensitive material to development processing.

As examples of using this basic principle, fuel supplying apparatus have been proposed, as disclosed in Japanese Patent Publication Nos. 44989/1987 and 2858/1987.

Each of the small holes 36 is disposed at a position corresponding to a crest of a wave when the diaphragm 34 is vibrated in waveform. Accordingly, since the small holes 36 are formed at positions where they are displaced by a maximum degree, a maximum pressing force for pressing the developing solution in the pressurizing chamber 30 can be obtained. In addition, since the small holes 36 are formed at portions corresponding to the crests of the waves, the developing solution is jetted substantially horizontally from the small holes 36 to the electrophotographic film 22 so as to be supplied to the electrophotographic film 22. In other words, since the developing solution is jetted substantially horizontally from the plurality of small holes 36, the developing solution is supplied uniformly to the surface of the electrophotographic film 22.

In addition, since in this embodiment the piezoelectric vibrators 38 are used to vibrate the diaphragm 34, it is possible to make the developing section 16 and, hence, the overall apparatus compact.

After the developing solution is supplied to the electrophotographic film 22 and development processing is thereby effected, the excess developing solution remaining in the developing chamber 44 is collected in the gas/liquid separator 80, and the liquid (developing solution) is recovered after being separated from air.

A predetermined frame of the electrophotographic film 22 for which development processing is completed in the developing section 16 is located in the drying section 18 by the unillustrated film-moving motor. In this drying section 18, warm air is blown to the electrophotographic film 22 to dry the wet electrophotographic film 22.

Subsequently, the predetermined frame located in the drying section 18 is moved to the fixing section 20. Cool air is supplied to the predetermined frame which has been moved to the fixing section 20. After a lapse of a predetermined time, an unillustrated xenon lamp disposed in the fixing section 20 is lit to allow the developing solution to be fused with the surface of the frame and to be fixed. This completes the fixing process.

Upon completion of the above-described processes, the recording of an image on the electrophotographic film 222 is completed.

It should be noted that although in this embodiment a description has been given of an example in which the present invention is applied to the supply of a developing solution to an electrophotographic film such as a microfilm or the like for recording an image, it is also possible to apply the present invention to the supply of a developing solution to a film used in a silver salt picture.

Figure 6:
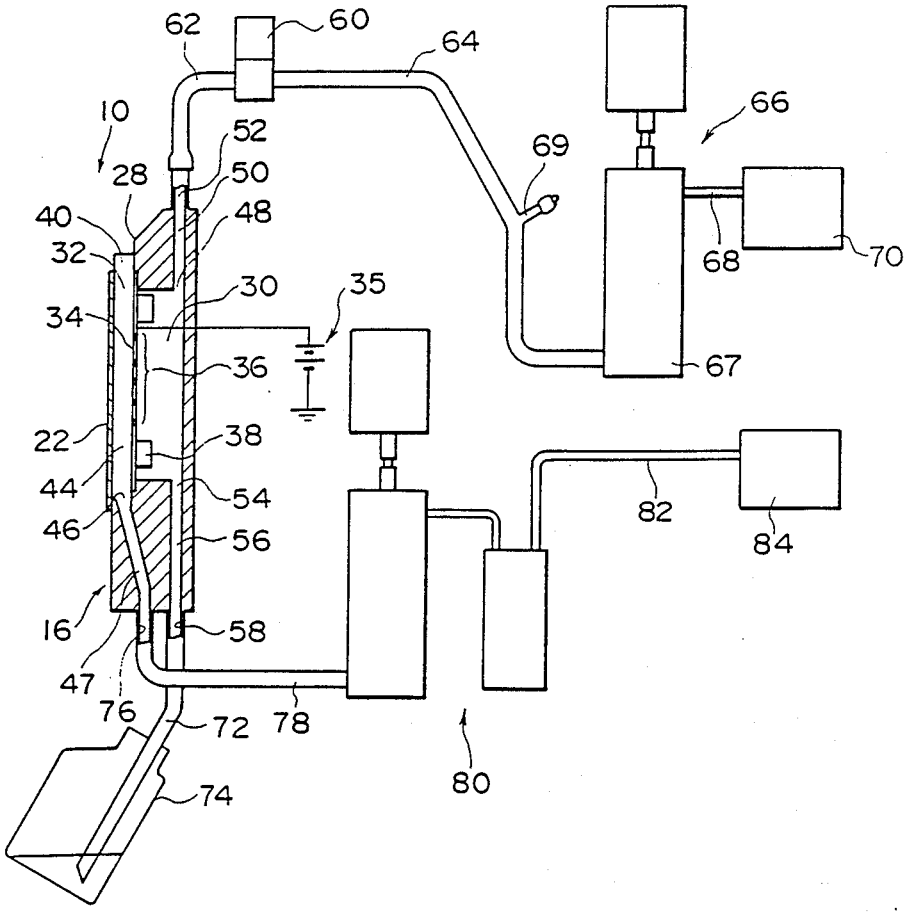
FIG. 6 is a cross-sectional view corresponding to FIG. 1, illustrating a developing section of a process head of a developing apparatus in accordance with a second embodiment.
Figure 7:
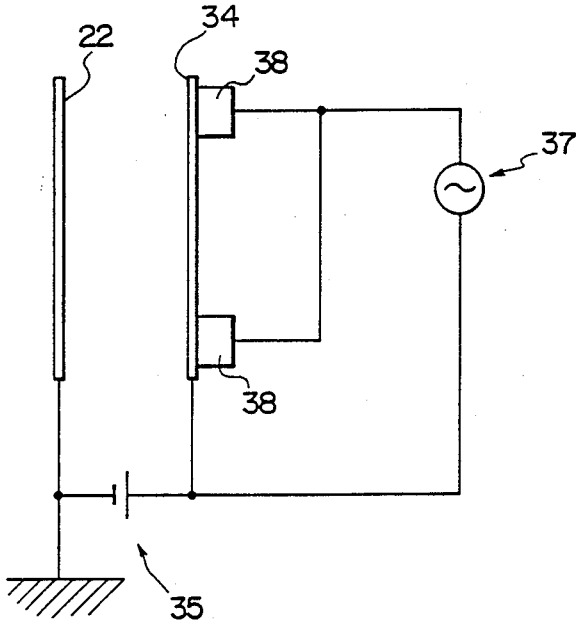
FIG. 7 is a circuit diagram illustrating connection between a bias power source and a power source for vibration in accordance with the second embodiment.

Referring now to FIGS. 6 and 7, a description will be given of a second embodiment of the present invention.

In this second embodiment, those components that are identical with those of the first embodiment are denoted by the same reference numerals, and a description thereof will be omitted.

In this embodiment, the diaphragm 34, which also serves as a developing electrode, is connected to a DC power source 35 and is adapted to apply a bias voltage to the electrophotographic film 22 so as to control the amount of developing solution attached. Namely, this power source 35 has a voltage varying means which is capable of varying its supply voltage. The voltage applied to the diaphragm 34 is variable in the range of, for instance, 50–300 V or thereabouts.

The pair of piezoelectric vibrators are respectively formed in upper and lower portions of the diaphragm 34 on a rear side thereof, i.e., on the inner side of the process head 10. As shown in FIG. 7, the piezoelectric vibrators 38 are connected to an AC power source 37 which is a voltage applying means. The AC power source 37 is connected to one terminal of the bias power source 35 which is a DC power source, and the other terminal of the bias power source 35 is connected to the electrophotographic film 22 and is grounded. For this reason, even if the piezoelectric vibrators 38 are used as developing electrodes, the piezoelectric vibrators 38 are not affected by the bias power source 35.

Since the other arrangements of this embodiment are identical as those of the first description, a description thereof will be omitted.

A description will now be given of the operation of this embodiment.

When the predetermined frame of the electrophotographic film 22 is moved to the developing section 16, a voltage is applied to the piezoelectric vibrators 38 by means of the AC power source 37. Upon application of this voltage thereto, the piezoelectric vibrators 38 vibrate vertically as viewed in FIG. 7, thereby causing the diaphragm 34 to expand and shrink in a vertical direction. By virtue of this expansion and shrinkage, an intermediate portion of the diaphragm 34 vibrates in waveform. As a result, the developing solution in the pressurizing chamber 30 is jetted from the small holes 36 into the developing chamber 44 in the form of droplets and is supplied thereto in the form of a mist, and the surface of the one frame of the electrophotographic film 22 is coated therewith. Consequently, an electrostatic latent image thus formed on the electrophotographic film 22 is converted into a visible image by this developing solution.

In this embodiment, in effecting above-described development, a voltage is applied to the piezoelectric vibrators 38 by the AC power source 37, and a bias voltage is applied to the diaphragm 34 by the DC power source 35. In addition, this bias voltage can be varied by the voltage varying means. Hence, it is possible to vary the state of vibration of the diaphragm 34 by varying the level of the voltage applied to the diaphragm 34. Accordingly, the amount of developing solution supplied to the surface of the frame of the electrophotographic film 22 can be adjusted, and a desired state of development is obtained for the frame of the electrophotographic film 22.

Since the operation of this embodiment in the other aspects is identical with the first embodiment, a description thereof will be omitted.

What is claimed is:

1. A developing apparatus for developing a developing area of a light-sensitive material by supplying a developing solution thereto, comprising:

a multiple-hole plate in which a plurality of small holes are formed in correspondence with said developing area of said light-sensitive material;

a pressurizing chamber which is provided on the side of said multiple plate which is remote from the side where said light-sensitive material is provided, a part of said pressurizing chamber being defined by said multiple-hole plate;

supplying means for supplying the developing solution to said pressurizing chamber; and pressurizing means for periodically pressurizing the developing solution in said pressurizing chamber so as to cause the developing solution to be jetted and supplied to said developing area in the form of droplets via said small holes.

2. A developing apparatus according to claim 1, wherein said pressurizing means comprises vibrating means for vibrating said multiple-hole plate so as to effect said pressurization.

3. A developing apparatus according to claim 2, wherein said said vibrating means comprises a piezoelectric element secured to said multiple-hole plate and adapted to vibrate in a direction substantially parallel to a surface of said multiple-hole plate upon application of an AC voltage thereto, thereby causing said multiple-hole plate to vibrate.

4. A developing apparatus according to claim 3, wherein said multiple-hole plate is formed of an electrically conductive material and serves as a developing electrode.

5. A developing apparatus according to claim 4, further comprising bias voltage applying means for applying a bias voltage to said multiple-hole plate.

6. A developing apparatus according to claim 5, wherein said bias voltage applying means comprises bias voltage varying means for varying said bias voltage.

7. A developing apparatus according to claim 1, further comprising removing means for removing an excess portion of the developing solution jetted to said developing area.

8. A developing apparatus according to claim 6, wherein said removing means comprises air supplying means for supplying an air current between said developing area and said multiple-hole plate so as to remove said excess portion.

9. A developing apparatus according to claim 1, wherein said multiplicity of small holes are arranged in the form of a lattice.

10. A developing apparatus according to claim 1, wherein said multiplicity of small holes are arranged in zigzag form.

11. A developing apparatus according to claim 1, further comprising preventing means for preventing the jetted developing solution from scattering in a predetermined direction.

12. A developing apparatus for effecting development by supplying a development solution to each developing area of an elongated light-sensitive material, comprising:

a multiple-hole plate in which a plurality of small holes are formed in correspondence with said developing area;

a pressurizing chamber which is provided on the side of said multiple-plate which is remote from the side where said light-sensitive material is provided, a part of said pressurizing chamber being defined by said multiple-hole plate;

supplying means for supplying the developing solution to said pressurizing chamber;

pressurizing means for periodically pressurizing the developing solution in said pressurizing chamber by vibrating said multiple-hole plate so as to cause the developing solution to be jetted and supplied to said developing area in the form of droplets via said small holes.

13. A developing apparatus according to claim 12, wherein said said vibrating means comprises a piezoelectric element secured to said multiple-hole plate and adapted to vibrate in a direction substantially parallel to a surface of said multiple-hole plate upon application of an AC voltage thereto, thereby causing said multiple-hole plate to vibrate.

14. A developing apparatus according to claim according to claim 13, wherein said piezoelectric element is constituted by a piezoelectric vibrator.

15. A developing apparatus according to claim 14, wherein said multiple-hole plate is formed of an electrically conductive material and serves as a developing electrode.

16. A developing apparatus according to claim 15, further comprising bias voltage applying means for applying a bias voltage to said multiple-hole plate.

17. A developing apparatus according to claim 16, wherein said bias voltage applying means comprises bias voltage varying means for varying said bias voltage.

18. A developing apparatus according to claim 12, further comprising preventing means for preventing part of the developing solution from scattering in a longitudinal direction of said light-sensitive material by going beyond said developing area to which the developing solution is to be supplied at the time when the developing solution is jetted.

19. A developing apparatus according to claim 18, wherein said preventing means is constituted by a pair of frames respectively located on the longitudinally opposite sides of said developing area of said light-sensitive material to be developed.

20. A developing apparatus according to claim 19, wherein said removing means includes air supplying means for supplying an air current to a space between said pair of frames along said frames.

* * * * *